US005655770A

United States Patent [19]

Ritchie et al.

[11] Patent Number: 5,655,770

[45] Date of Patent: Aug. 12, 1997

[54] PINBALL SOLENOID POWER CONTROL SYSTEM

[75] Inventors: Mark Dean Ritchie, Carol Steam; William Clark Pfutzenreuter, Arlington Heights, both of Ill.

[73] Assignee: Capcom Coin-Op, Inc., Arlington Heights, Ill.

[21] Appl. No.: 528,742

[22] Filed: Sep. 15, 1995

[51] Int. Cl.[6] ..... A63F 7/02; A63F 7/26

[52] U.S. Cl. ..... 273/129 V; 273/129 S; 361/160

[58] Field of Search ..... 273/121 A, 119 A, 273/118 A, 129 S, 129 V, 129 T, 129 N; 463/47, 48; 361/157, 153, 160, 170, 196; 200/61.1, 61.11

[56] References Cited

U.S. PATENT DOCUMENTS

| | | | |
|---|---|---|---|
| 4,093,232 | 6/1978 | Nutting | 273/121 |
| 4,198,051 | 4/1980 | Bracha | 273/121 |
| 4,203,602 | 5/1980 | Kral | 273/121 |
| 4,209,826 | 6/1980 | Priegnitz | 363/21 |
| 4,234,903 | 11/1980 | Harper | 361/154 |
| 4,272,649 | 6/1981 | Pfeiffer | 273/121 A |
| 4,293,888 | 10/1981 | McCarty | 361/152 |
| 4,363,485 | 12/1982 | Edwall | 273/121 A |
| 4,384,716 | 5/1983 | Powers | 273/121 |
| 4,399,483 | 8/1983 | Phelan | 361/154 |
| 4,511,945 | 4/1985 | Nielsen | 361/154 |
| 4,546,403 | 10/1985 | Nielsen | 361/152 |
| 4,599,674 | 7/1986 | Ishikawa | 361/154 |
| 4,634,126 | 1/1987 | Kimura | 273/129 S |
| 4,825,332 | 4/1989 | Aoki | 361/152 |
| 4,895,369 | 1/1990 | Deger | 273/119 A |
| 5,074,558 | 12/1991 | Bleich | 273/121 A |
| 5,091,677 | 2/1992 | Bleich | 315/360 |
| 5,092,597 | 3/1992 | Kaminkow | 273/129 |
| 5,146,388 | 9/1992 | Parker et al. | 361/153 |
| 5,149,094 | 9/1992 | Tastad | 283/119 A |
| 5,170,345 | 12/1992 | Poole | 273/121 A |
| 5,284,342 | 2/1994 | Tanzer | 273/129 V |
| 5,297,793 | 3/1994 | DeMar et al. | 273/119 A |
| 5,322,282 | 6/1994 | Lund | 273/129 S |
| 5,539,608 | 7/1996 | Hurlet et al. | 361/152 |

FOREIGN PATENT DOCUMENTS

| | | | |
|---|---|---|---|
| 0068006 | 4/1982 | Japan | 361/152 |
| 06304301 | 11/1994 | Japan | 273/129 S |

OTHER PUBLICATIONS

IBM Technical Disclosure Bulletin, "Pulse–Width Modulation of Magnets" by Wells, vol. 21, No. 3, Aug. 1978 Aug. 1978.

Design News, "The uP says TILT!—pinball machines grow smarter", vol. 23, No. 1, pp. 16–18. Jan. 1978.

*Primary Examiner*—Jessica Harrison
*Assistant Examiner*—James Schaaf
*Attorney, Agent, or Firm*—Gary R. Jarosik

[57] ABSTRACT

A pinball machine is provided and includes one or more solenoids for activating one or more play feature mechanisms and a microprocessor for controlling game play activities. The microprocessor has associated therewith a clock for providing timed signals thereto, a memory device having stored therein a plurality of power setting patterns, and a driver. Each of the power setting patterns generally comprises a series of states (ON and OFF) over a predetermined number of counts of the timed signal. One of these patterns is used for each solenoid desired to be controlled. The driver is responsive to the microprocessor for controlling the flow of current to the desired solenoid wherein the driver utilizes the selected pattern to supply pulse width modulated current to the solenoid as a function of the states in the pattern. Preferably, the pattern selected can be changed as desired.

27 Claims, 4 Drawing Sheets

POWER SETTING

| INTERRUPT COUNT | 6% | 12% | 75% | 81% | 88% | 94% | 100% |
|---|---|---|---|---|---|---|---|
| 0 | ON | ON | ON | ON | ON | OFF | ON |
| 1 | OFF | OFF | ON | ON | ON | ON | ON |
| 2 | OFF | OFF | ON | ON | ON | ON | ON |
| 3 | OFF | OFF | OFF | OFF | OFF | ON | ON |
| 4 | OFF | OFF | ON | ON | ON | ON | ON |
| 5 | OFF | OFF | ON | ON | ON | ON | ON |
| 6 | OFF | OFF | ON | ON | ON | ON | ON |
| 7 | OFF | ON | OFF | ON | ON | ON | ON |
| 8 | OFF | OFF | ON | OFF | ON | ON | ON |
| 9 | OFF | OFF | ON | ON | ON | ON | ON |
| 10 | OFF | OFF | ON | ON | OFF | ON | ON |
| 11 | OFF | OFF | OFF | ON | ON | ON | ON |
| 12 | OFF | OFF | ON | ON | ON | ON | ON |
| 13 | OFF | OFF | ON | OFF | ON | ON | ON |
| 14 | OFF | OFF | ON | ON | ON | ON | ON |
| 15 | OFF | OFF | ON | ON | ON | ON | ON |

*FIG. 4*

PINBALL SOLENOID POWER CONTROL SYSTEM

BACKGROUND OF THE INVENTION

This invention relates generally to a system for controlling power to a play feature utilized in coin operated games and, more particularly, relates to a system for adjusting the average amount of current supplied to a solenoid used to move a play feature in a pinball game.

Presently, solenoids used to move play features located in a game cabinet (i.e the playfield, back box, etc.) are subject to mechanical degradation due to wear which, over time, causes a diminution in the feature's ability to move. This is especially true for flipper mechanisms where the loss of movement continues to the point where the flipper mechanism may no longer be used to impart sufficient speed to the pinball to allow the pinball to reach scoring features located on the upper portion of the playfield. In an attempt to cure this problem, pinball manufacturers currently require that the play feature coils (the coils of the solenoid used to move the play feature) be designed to accept an excess of current to provide excess speed in order to overcome the eventual losses. It has been seen, however, that this overdesign itself accelerates the wear on the mechanisms and, therefore, does not adequately address this problem. Furthermore, with respect to flipper mechanisms, this design also suffers from the problem that the power of the flipper still varies or diminishes over time which results in an undesirable change in the "feel" of the game.

Another attempted solution to this problem has been seen in the past on coin operated baseball games. In these games a rheostat has been used to adjust the power of the "bat". This attempted solution, however, suffers from, among other disadvantages, the disadvantages of requiring the operator to access the "guts" of the machine each time the power is to be adjusted and inexactness in the adjustment process whereby multiple entries into the machine are required before the correct setting can be attained. Therefore, it is seen that a need exists for a power adjustment system which may be easily utilized to correct the degradation problem caused by wear on play feature component parts.

As a result of this existing need, it is an object of the present invention to provide a power adjustment system which is easily utilized without requiring the operator to access the "guts" of the machine.

It is another object of the present invention to provide a power adjustment system which will allow a game to be shipped with the game feature adjusted to the minimum power setting required to operate.

It is yet another object of the present invention to provide a power adjustment system which will allow the operator to establish a uniform power setting over time for the play feature despite degradation of the component parts used therein whereby the "feel" of the game may be constantly maintained.

It is still another object of the present invention to provide a power adjustment system which the operator may use to alter game play conditions to a desired level of difficulty.

It is still a further object of the present invention to provide a power adjustment system which will allow the manufacturer of a pinball game to specify and use a common solenoid throughout the game while allowing these solenoids to operate nonuniformly depending upon the requirements of the play feature which they are used to control.

SUMMARY OF THE INVENTION

In accordance with the present invention, a pinball machine is provided comprising a solenoid for activating a play feature device, a microprocessor for controlling game play activities, and a memory device associated with the microprocessor having stored therein a plurality of power settings. A driver responsive to the microprocessor is employed for controlling the flow of current to the solenoid based upon a predetermined one of the plurality of power settings. The predetermined power setting may be selected or changed by the operator or it may be factory preset.

A better understanding of the objects, advantages, features, properties and relationships of the invention will be obtained from the following detailed description and accompanying drawings which set forth an illustrative embodiment and is indicative of the various ways in which the principles of the invention may be employed.

BRIEF DESCRIPTION OF THE DRAWINGS

For a better understanding of the invention, reference may be had to the preferred embodiment shown in the following drawings in which:

FIG. 4 illustrates in tabular form the power setting pattern used in conjunction with the subfunction illustrated in FIG. 3A.

DETAILED DESCRIPTION

While the invention can be used in conjunction with any type of movable play feature found in a coin operated game it will be described hereinafter in the context of a flipper mechanism as found in a pinball machine as the preferred embodiment thereof.

Figure 1:
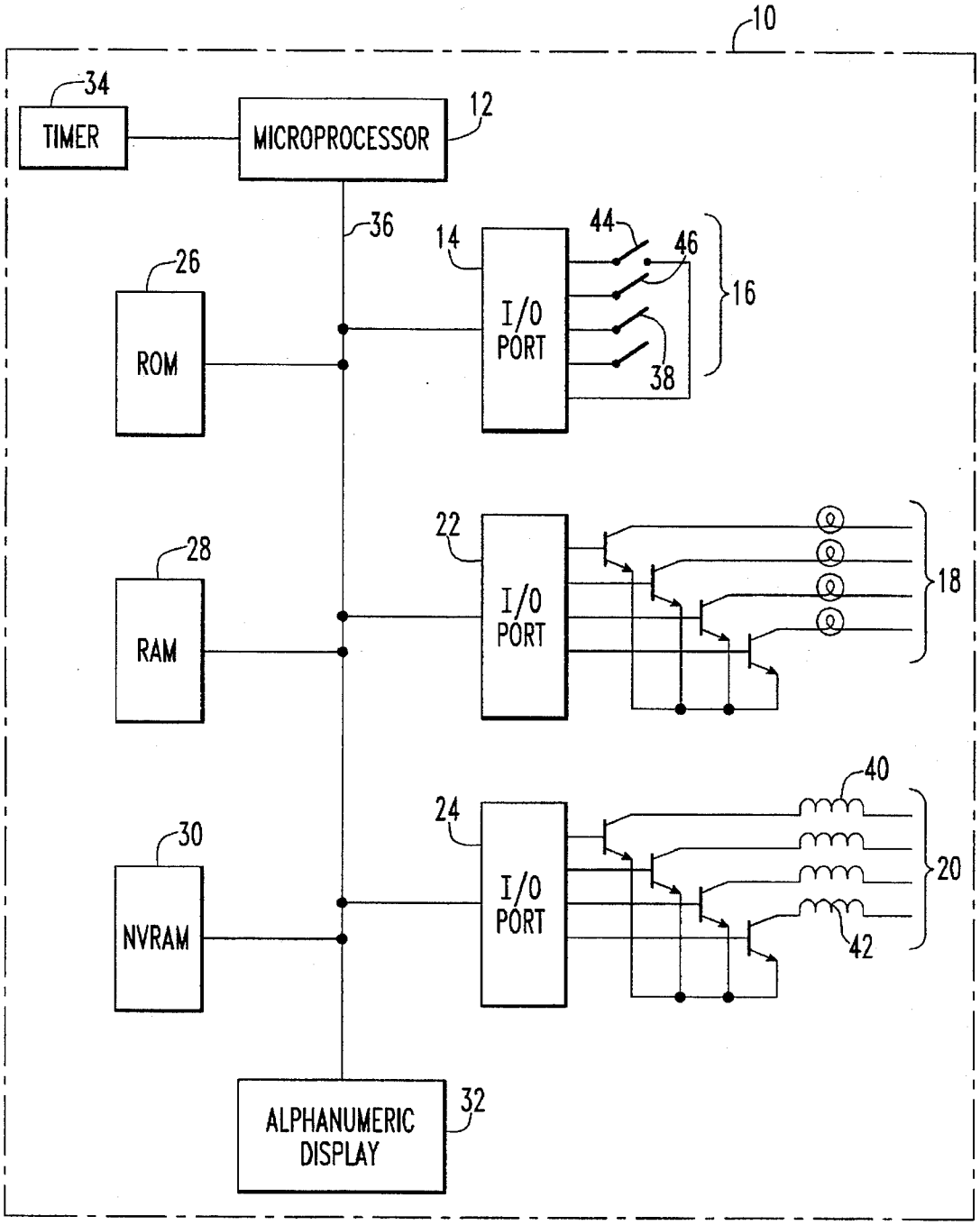
FIG. 1 illustrates in block diagram form a pinball machine in which the subject invention resides.

Referring now to the figures, wherein like reference numerals refer to like elements, there is shown in block diagram format in FIG. 1 a pinball machine 10. As will be understood by those skilled in the art, the pinball machine 10 generally comprises a microprocessor 12 for executing operating instructions based on information received via an I/O port 14 from switches 16 associated with game cabinet. The microprocessor 12 utilizes this information to control various lamps 18, solenoids 20, and like devices via I/O ports/drivers 22,24. Software instructions for carrying out the play of the game are typically stored in a ROM 26 while temporary information relating to game conditions are stored in a RAM 28. Information relating to specific operating parameters such as the price of the game, the scores required for free games, and the like are preferably stored in a non-volatile memory or NVRAM 30 whereby such information may be maintained during loss of power. In addition, an alphanumeric display 32 is utilized to provide, among other things, animation or information to a player, and information to the operator during setup, diagnostics, and/or retrieval of game play statistics. The microprocessor 12 accesses and/or controls all of these various components via a bus 36.

As is typical, the game software in ROM 26 includes various interrupt routines which may be executed periodically when triggered by a timer or clock 34 (periodic interrupt routines) or in response to other predetermined interrupt conditions (conditional interrupt routines). If periodic interrupt routines are utilized, the rate of the clock 34 should generally be less than 1 millisecond, preferably generating an interrupt signal every 250 microseconds, so the action of the interrupt routines is not visible to the player.

In response to an interrupt condition, the interruption of the main program flow and the execution of the appropriate interrupt routines occurs. Once completed, control is again returned to the main program whereafter the main program continues to execute from the point at which it was interrupted. The various interrupt routines may be used to count multiple interrupts for timing longer intervals in response to clock generated interrupts, to transfer scores or other data to the displays, or for performing other similar activities. In accordance with the present invention, the interrupt routines may also be used to regulate the current supplied to the flipper coils and, therefore, the power of the flippers. Preferably, this is accomplished by means of pulse width modulation.

Figure 2:
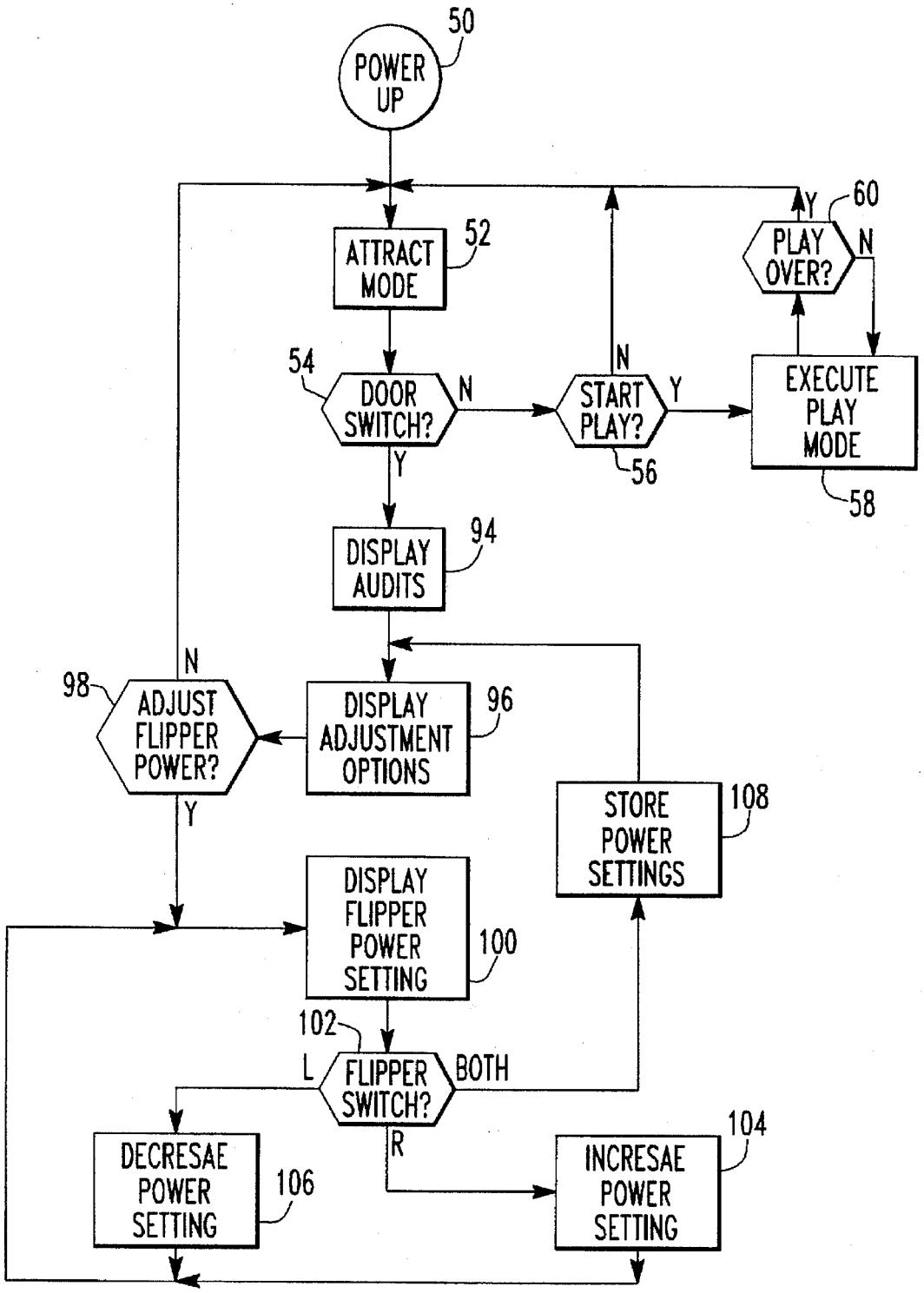
FIG. 2 illustrates a flow chart depicting the general operation of the pinball machine shown in FIG. 1.

With reference to FIGS. 1 and 2, operation of the game is generally described. From power up (flow chart element 50) the game enters the attract mode (52) which preferably causes various images to be displayed on the alphanumeric display 32 and various lamps 18 to become illuminated for the purpose of drawing a player's attention to the machine. During the attract mode (52) a door switch 38 is constantly monitored (54) to determine whether the machine is player ready or operator ready. If the door switch 38 indicates that the machine is in player mode (i.e. the door switch is "open") a coin detect switch and start switch (not shown) are also repeatedly tested (56) to determine if the machine should start game play (58). Since the specific actions for starting game play in response to the activation of the coin detecting switch, the start switch, and other associated switches are well understood in the art they will not be described in further detail herein. If, however, the door switch 38 indicates the machine is in operator mode (i.e. the service door of the game is open and the associated switch is in the "closed" position) the machine, as will be described hereinafter, allows various operator related activates to be performed.

Once the machine enters game play (58) the instructions related to game play are executed until it is determined that game play is over (60). Upon the end of game play the machine returns to the attract mode (52). As discussed previously, during the execution of the game play instructions, the clock 34 may be used to cause a periodic interrupt routine to execute.

Figure 3:
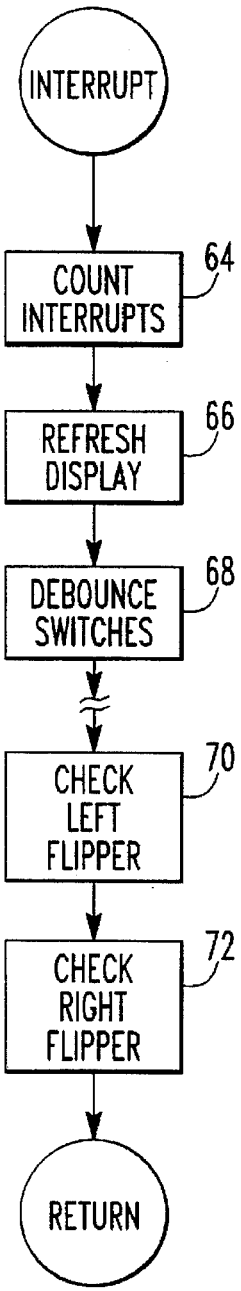
FIG. 3 illustrates an interrupt routine which interrupts the general operation of the pinball machine shown in FIG. 1 for performing operation specific subfunctions.
Figure 3A:
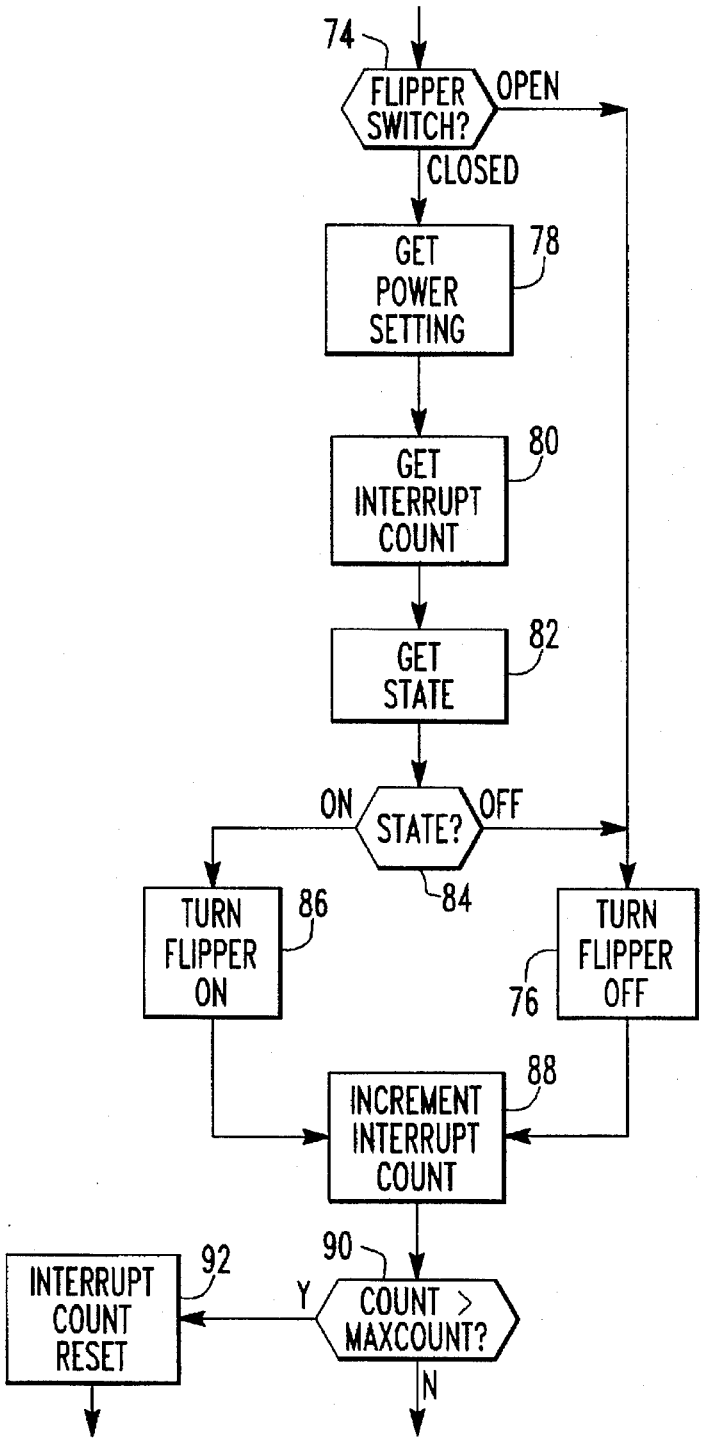
FIG. 3A illustrates the specific subfunction related to the control of a flipper mechanism residing in the pinball machine of FIG. 1.

A periodic interrupt routine is generally shown in FIG. 3 and may be considered to be an independent program except that data in RAM 28 and NVRAM 30 are shared with the main program. In the described embodiment, the periodic interrupt routine comprises, among other subroutines (not shown), a subroutine (64) which counts multiple interrupts for timing longer intervals, a subroutine (66) which transfers scores or other data to the display, and a subroutine (68) which is used for switch debounce. Again, since these subroutines are well known in the art, they will not be described in greater detail herein. In addition, the periodic interrupt routine also includes subroutines (70 and 72) which are utilized to control left and right flippers via corresponding flipper coils 40 and 42. These identical subroutines are more clearly illustrated in FIG. 3*a*.

As noted, with each execution of the periodic interrupt routine the left and right flipper control subroutines (70 and 72) are also executed. These subroutines first examine the state (74) of the appropriate flipper switch 44 or 46. If the switch is open (i.e. it is not desired to activate the corresponding flipper), the corresponding flipper is turned off (76) with the microprocessor 28 directing the I/O driver 24 to prevent or interrupt current flow to the corresponding flipper coils. If the switch is closed (i.e. it is desired to activate the corresponding flipper), the flipper power setting is first retrieved (78).

The various flipper power settings are located in ROM 26 where each of the plurality of power settings comprises a pattern of states (ON and OFF—i.e. whether or not current is to be supplied to the flipper coils) over a predetermined number of successive interrupt counts. In the preferred embodiment, illustrated as a table in FIG. 4, power settings ranging from 6% to 100%, with 6% step increases therebetween, are available each having an ON and OFF state pattern defined over a count of 16 interrupts. In the illustrated embodiment, for example, the power setting corresponding to 100% has a pattern of 16 successive ON states or one for each of the 16 interrupt counts while the power setting corresponding to 75% has a pattern of 3 successive ON states followed by an OFF state over the count of 16 interrupts. As will be described, the power setting selected for each flipper is preferably stored in the NVRAM 30.

Returning to FIG. 3*a*, the retrieval of the flipper power setting (78) is performed by reading from the NVRAM 30 a pointer representing the desired pattern or power setting level within the power setting table to be utilized for the particular flipper. A second offset pointer is then read (80) from RAM 28 which represents the current interrupt count. These two pointer are utilized to retrieve (82) from the power setting table the state the corresponding solenoid is to be placed in. This may be accomplished by, for example, adding the two pointers to determine the specific address within the power setting table where the state to be retrieved is located. Once the state has been retrieved (82), the microprocessor 28 then determines (84) whether or not current is to be supplied to the flipper coils via the I/O drivers 24. Specifically, if the state is OFF the microprocessor 28 directs the I/O driver 24 to prevent or interrupt current flow to the corresponding flipper coils (76) and if the state is ON the microprocessor 28 directs the I/O driver 24 to allow current to flow to the corresponding flipper coils (86). The supply or non-supply of current to the corresponding flipper coils to place the flipper coils in the desired state continues until the timed interrupt routine is again executed. Of course, when play ends the flippers are deactivated.

Finally, before exiting the subroutine, the interrupt count/pointer is incremented (88) and a test (90) is performed to ensure that the end of the pattern has not been surpassed. Specifically, if the pointer was at the maximum count, count 15 of the table column corresponding to the power setting selected, the incrementing process causes the pointer corresponding to the interrupt count to be next set to its initial value (92), the start of the table column at count 0. This ensures that the pointer remains in the appropriate power setting.

As disclosed, it should be apparent that the state of the driver 24 follows the pattern of the states in the power setting selected. As a result, the average value of the current being supplied to the flipper coils can be varied from a maximum of continuously ON current (100%) to some desired percentage thereof. It is to be noted that the short time between interrupts prevents the solenoid from materially changing its position when the pattern transitions between ON and OFF states and, therefore, no material amount of "fluttering" of the plunger should be experienced. This routine may be repeated for as many flippers or other solenoid controlled devices as are located on the machine.

Returning to FIG. 2, when the service door of the machine is determined to be open (54), this typically signals that the operator wishes to readout game data or make game adjustments. Therefore, it is desirable to provide to the operator via the alphanumeric display 32 the audit information (94) and available game adjustment options (96). Typically, the alphanumeric display instructs the operator which switches (i.e. left/right flipper button, start button, etc.) to press to obtain readouts and/or to effect changes in the game setup. While many game adjustments may be provided, such as altering the number of balls per play, the score needed for free play, etc., only the adjustment process related to flipper strength will be described herein.

After the operator decides to adjust the power settings of the flipper (98), by selecting this option from a menu provided when the available game adjustment options are displayed (96), the operator is thereafter directed to select the flipper to be adjusted by, for example, pressing the corresponding right or left flipper button (not shown). Once a flipper has been selected for adjustment, the previously selected power setting as stored in the NVRAM 30 may be displayed (100), either numerically or in graphical form, whereafter the operator may again use the flipper buttons to increase (104) or decrease (106) the power setting. Adjustment of the power setting may be accomplished by, for example, using the right flipper button to increase the power setting, the left flipper button to decrease the power setting, or both flipper buttons simultaneously to exit (102). Any adjustments are preferably reflected concurrently on the display (100). While not preferred, it is also contemplated that the power setting selection process could be accomplished by utilizing hardware such as rotary switches, dip switches, or the like where certain switch configurations correspond to certain power settings.

Upon exiting, the new power setting is stored (108) in the NVRAM 30 and the operator is again given the opportunity to make further adjustments. If no further adjustments are desired the operator may once again place the game in the attract mode (52). From the preceding description it should also be apparent that this invention may be used to allow solenoids having the same current rating to be used throughout the pinball machine. In particular, for each solenoid located on the machine, the desired, specific power setting from the table illustrated in FIG. 4 would be assigned to the corresponding solenoid based upon the requirements of the play feature which the solenoid controls. This assigned power setting could be factory preset or adjustable using the above-described techniques. This results in the advantage of being able to specify, purchase, and warehouse only one specific solenoid part.

While specific embodiments and objectives of the invention have been described in detail, it will be appreciated by those skilled in the art that various modifications and alternatives to those details could be developed in light of the overall teachings of the disclosure. Accordingly, the particular arrangements disclosed are meant to be illustrative only and not limiting as to the scope of the invention which is to be given the full breadth of the appended claims and any equivalent thereof.

What is claimed:

1. A pinball machine, comprising:

a solenoid for activating a play feature device;

a microprocessor for controlling game play activities;

a first memory device linked with said microprocessor having concurrently stored therein a plurality of power settings;

a selector linked with said microprocessor for selecting one of said plurality of power settings; and a driver responsive to said microprocessor for controlling the flow of current to said solenoid based upon said selected one of said plurality of power settings.

2. The pinball machine as recited in claim 1 wherein said play feature device comprises a flipper.

3. The pinball machine as recited in claim 2 further comprising a second memory device linked with said microprocessor in which a pointer to said selected one of said plurality of power settings is stored.

4. The pinball machine as recited in claim 3 wherein said second memory device is non-volatile.

5. The pinball machine as recited in claim 3 wherein said selector comprises a display linked with said microprocessor for displaying said plurality of power settings and a switch linked with said microprocessor for use in selecting said selected one of said plurality of power settings.

6. A pinball machine, comprising:

a solenoid for activating a play feature device;

a microprocessor for controlling game play activities;

a memory device linked with said microprocessor having concurrently stored therein a plurality of power settings; and a driver responsive to said microprocessor for controlling the flow of current to said solenoid based upon a predetermined one of said plurality of power settings.

7. The pinball machine as recited in claim 6, wherein said predetermined one of said plurality of power settings is selected utilizing a switch linked with said microprocessor.

8. A pinball machine, comprising:

a solenoid for activating a flipper mechanism;

a microprocessor for controlling game play activities;

a clock linked with said microprocessor for providing timed signals thereto;

a memory device linked with said microprocessor having concurrently stored therein a plurality of power setting patterns, each of said power setting patterns comprising a series of states defined over a predetermined number of counts of said timed signal;

a driver responsive to said microprocessor for controlling the flow of current to said solenoid wherein said driver utilizes a select one of said plurality of power setting patterns to supply pulse width modulated current to said solenoid as a function of said series of states.

9. A pinball cabinet, comprising:

a cabinet having a plurality of movable play features;

a plurality of solenoids for use in controlling the movement of said plurality of movable play features;

a microprocessor for controlling game play activities;

a memory device linked with said microprocessor having concurrently stored therein a plurality of power settings; and a driver circuit responsive to said microprocessor for supplying one of a plurality of currents to each of said plurality of solenoids, each one of said plurality of currents being based on one of said plurality of power settings.

10. The pinball machine as recited in claim 9 further comprising a selector associated with said microprocessor for selecting said one of said plurality of power settings for each of one of said plurality of currents.

11. The pinball machine as recited in claim 9 wherein said plurality of power settings each comprise a pattern having a predetermined number of states and wherein said driver circuit utilizes said pattern to supply pulse width modulated current to said plurality of solenoids as a function of said states.

12. The pinball machine as recited in claim 1 wherein said plurality of power settings each comprise a pattern having a predetermined number of states and wherein said driver circuit utilizes said pattern to supply pulse width modulated current to said plurality of solenoids as a function of said states.

13. The pinball machine as recited in claim 6 wherein said plurality of power settings each comprise a pattern having a predetermined number of states and wherein said driver utilizes said pattern to supply pulse width modulated current to said solenoid as a function of said states.

14. A method for controlling the operation of a solenoid controlled, pinball play feature comprising the steps of:

a) issuing a command to cause the operation of said play feature during the course of pinball play in response to a predetermined play condition; and b) supplying current to said solenoid in response to said command based upon a selected one of a plurality of power settings concurrently stored in a memory device.

15. The method as recited in claim 14 wherein each of said plurality of power settings comprises a pattern having a predetermined number of states and said step of supplying current comprises utilizing said pattern to supply pulse width modulated current to said solenoid as a function of said states.

16. The method as recited in claim 14 further comprising the step of providing a selector for allowing said current to be based on a different one of said plurality of power settings stored in said memory device.

17. The method as recited in claim 14 wherein the step of issuing a command further comprises the steps of waiting for an interrupt signal and polling a switch associated with said play feature to determine if said predetermined play condition exists.

18. The method as recited in claim 15, wherein each of said states is defined over a predetermined, uniform time period.

19. The pinball machine as recited in claim 8, further comprising a selector associated with said microprocessor for selecting said select one of said plurality of power setting patterns.

20. The pinball machine as recited in claim 1 further comprising a second memory device associated with said microprocessor in which a pointer to said selected one of said plurality of power settings is stored.

21. The pinball machine as recited in claim 12, wherein each of said states is defined over a predetermined, uniform time period.

22. The pinball machine as recited in claim 13, wherein each of said states is defined over a predetermined, uniform time period.

23. The pinball machine as recited in claim 2 wherein said plurality of power settings each comprise a pattern having a predetermined number of states and wherein said driver utilizes said pattern to supply pulse width modulated current to said solenoid as a function of said states.

24. The pinball machine as recited in claim 23, wherein each of said states is defined over a predetermined, uniform time period.

25. The pinball machine as recited in claim 24, further comprising a clocking circuit associated with said microprocessor which generates a timed interrupt and wherein the period between said timed interrupts establishes said predetermined, uniform time period.

26. The pinball machine as recited in claim 21, further comprising a clocking circuit associated with said microprocessor which generates a timed interrupt and wherein the period between said timed interrupts establishes said predetermined, uniform time period.

27. The pinball machine as recited in claim 22, further comprising a clocking circuit associated with said microprocessor which generates a timed interrupt and wherein the period between said timed interrupts establishes said predetermined, uniform time period.

* * * * *